US010593310B2

(12) United States Patent
Klein

(10) Patent No.: US 10,593,310 B2
(45) Date of Patent: Mar. 17, 2020

(54) MUSICAL INSTRUMENT MUTE RETENTION ASSEMBLY WITH PERPENDICULAR MOUNTING FLANGE

(71) Applicant: Steven D. Klein, Monterey Park, CA (US)

(72) Inventor: Steven D. Klein, Monterey Park, CA (US)

( * ) Notice: Subject to any disclaimer, the term of this patent is extended or adjusted under 35 U.S.C. 154(b) by 0 days.

(21) Appl. No.: 16/271,707

(22) Filed: Feb. 8, 2019

(65) Prior Publication Data

US 2019/0244592 A1 Aug. 8, 2019

Related U.S. Application Data

(60) Provisional application No. 62/628,165, filed on Feb. 8, 2018.

(51) Int. Cl.
*G10G 7/00* (2006.01)

(52) U.S. Cl.
CPC ..... *G10G 7/00* (2013.01)

(58) Field of Classification Search
CPC ..... G10G 7/00; G10G 5/00; G10D 3/046
See application file for complete search history.

(56) References Cited

U.S. PATENT DOCUMENTS 6,143,970 A * 11/2000 Kowzan ..... G10D 3/046 211/70.1

* cited by examiner

*Primary Examiner* — Kimberly R Lockett

(57) ABSTRACT

A musical instrument mute retention assembly with perpendicular mounting flange mount to a music stand at a parallel disposition with the ground surface, while also retaining multiple instrument mutes of various sizes and musical-related items in a level, upright disposition. The assembly provides a mute panel defined by mute apertures disposed in a linear, spaced-apart relationship. The mute panel also provides music item apertures disposed in a linear, spaced-apart relationship, and further being parallel to the mute apertures. A mounting flange fixedly attaches to the mute panel in a perpendicular disposition. The mounting flange interfaces with a gapped flange that extends from a sloped support panel of a music stand in slidable or fastenable engagement. Because the mounting flange is perpendicular to the mute panel, the retained mutes and music-related items are maintained parallel with the ground surface, facilitating access to the apertures and retained mutes.

15 Claims, 4 Drawing Sheets

MUSICAL INSTRUMENT MUTE RETENTION ASSEMBLY WITH PERPENDICULAR MOUNTING FLANGE

CROSS-REFERENCE OF RELATED APPLICATION

This application claims the benefit of a U.S. provisional application No. 62/628,165, filed on Feb. 8, 2018 and entitled "Musical Instrument Mute Retention Assembly with Perpendicular Mounting Flange," which provisional application is incorporated by reference herein in its entirety.

FIELD OF THE INVENTION

The present invention generally relates to a musical instrument mute retention assembly with perpendicular mounting flange. More so, an instrument mute holding retention assembly mounts to a music stand at a parallel disposition with the ground surface, while also retaining multiple instrument mutes of various sizes and musical-related items in a level, upright disposition; whereby the instrument mute holding retention assembly provides a mute panel defined by a plurality of mute apertures disposed in a linear, spaced-apart relationship, and a plurality of music item apertures disposed in a linear, spaced-apart relationship, parallel to the mute apertures; whereby a mounting flange fixedly attaches to the mute panel in a perpendicular disposition; whereby the mounting flange interfaces with a support shelf that extends from a sloped portion of a music stand in a slidable or fastenable engagement, such that the mute panel are maintained parallel with the ground surface.

BACKGROUND OF THE DISCLOSURE

Generally, a mute holder is a device to hold the music instrument mutes on a conventional music stand and then can be used to prevent the music instrument mutes being placed on the ground surface. In particular, while the musician is standing up to play music instruments, the musician can rapidly take, exchange, and return the music instrument mutes to the mute holder. In order to provide easy access to the required types of mutes during the playing of different types of music instruments, a variety of ways to attach the mute holder on the music stand are provided in the current market.

A conventional mute holder comprises a plurality of holder rings swingably mounted on a pivot, and a clamp portion connected to the pivot and configured to lock on a rod stand of the music stand. Therefore, the conventional mute holder can be affixed on the rod stand at different fixed levels. Accordingly, the clamp portion is needed to be adjusted to lock on the different thicknesses of the rod stand, and however, the clamp portion do not adapt well, nor can they be adjusted to hold the holder rings firmly. Also, a supplemental tool is required to adjust the clamp portion to attach the mute holder on the music stand.

U.S. Pat. No. 8,003,870 discloses a mute holder having a first member pivotably connected to a second member, wherein the first member comprises a plurality of receptacles to hold the music instrument mutes, and the second member comprises a top side to hang on the music stand and a bottom side to hingedly connect with the first member. However, the installation of the mute holder as disclosed in U.S. Pat. No. 8,003,870 is complicated to the user to attach the mute holder on the music stand immediately, and the structure of the mute holder is not sturdy to support the heavy-weighted mutes since the first member and the second member have consisted of a plurality of elongated metal/plastic strips.

Hence, there is a continuing need for a new design of mute holder configured to attach on the music stand, wherein the new design of mute holder is sturdy in construction and high efficient in operation.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the desires mentioned above. Although the present embodiments may obviate one or more of the desires mentioned above, it should be understood that some aspects of the embodiments might not necessarily obviate them.

BRIEF SUMMARY OF THE DISCLOSURE

In a general implementation, a musical instrument mute retention assembly includes a mute panel being defined by a plurality of mute apertures disposed in a linear, spaced-apart relationship; a plurality of music item apertures formed in a linear, spaced-apart relationship on the mute panel; and a U-shaped mounting flange integrally and vertically extended from the mute panel; wherein the mounting flange comprising a sloped portion and a support portion integrally extended from the sloped portion to form a retaining slot configured to mount a music stand in a slidable or fastenable engagement.

In another aspect combinable with the general implementation, the mute panel has a continuous edge and no opening is formed along the edge of the mute panel.

In another aspect combinable with the general implementation, the music item apertures can be arranged parallelly with the mute apertures.

In another aspect combinable with the general implementation, the mute panel is arranged parallelly with the ground surface.

In another aspect combinable with the general implementation, the sloped portion can be perpendicularly extended with respect to the mute panel.

In another aspect combinable with the general implementation, the retaining slot can be configured to engage with a support shelf of the music stand to support the mute panel on the music stand.

In another aspect combinable with the general implementation, the mute panel has a generally flat, rectangular shape.

In another aspect combinable with the general implementation, the plurality of mute apertures comprises four mute apertures.

In another aspect combinable with the general implementation, the plurality of mute apertures is sized and dimensioned to retain musical mutes in an upright disposition.

In another aspect combinable with the general implementation, the plurality of music item apertures comprises three music item apertures.

In another aspect combinable with the general implementation, the mounting flange has a generally flat, rectangular shape.

In another aspect combinable with the general implementation, a width of the mounting flange is generally smaller than the mute panel.

In another aspect combinable with the general implementation, the musical instrument mute retention assembly is an integrated piece.

In another aspect combinable with the general implementation, a length of the support portion is shorter than a length of the sloped portion.

Accordingly, the present disclosure is directed to a musical instrument mute retention assembly having a mounting flange configurated to engage with a support shelf of a music stand, wherein the musical instrument mute retention assembly can be attached on the music stand without using any supplemental tool.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

The invention will now be described, by way of example, with reference to the accompanying drawings, in which.

DETAILED DESCRIPTION OF THE INVENTION

Figure 1:
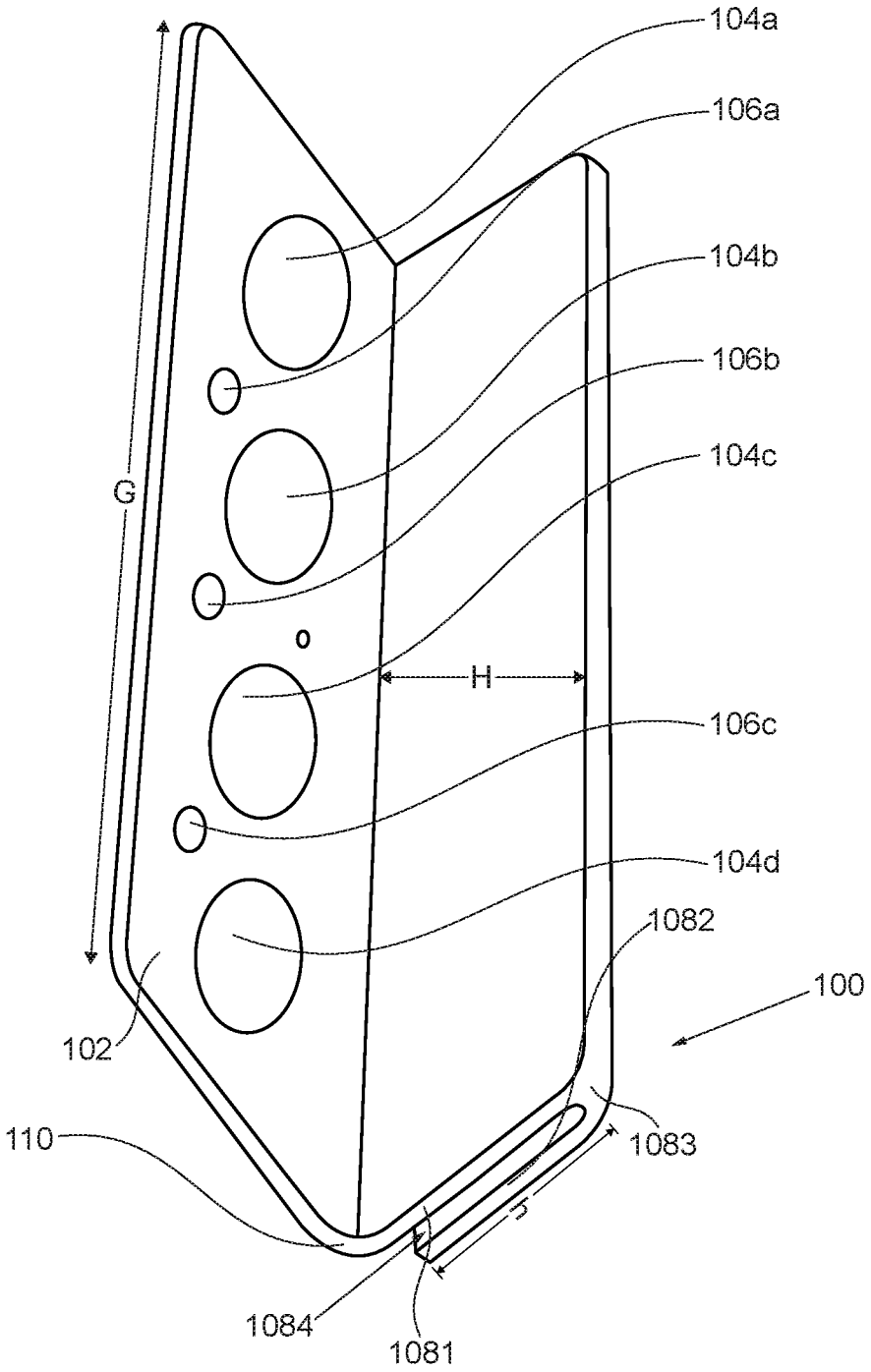
FIG. 1 is a perspective view of a musical instrument mute retention assembly according to a disclosed embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

FIG. 1 generally depicts the basic architecture of a musical instrument mute retention assembly in accordance with one of the disclosed embodiments.

The musical instrument mute retention assembly 100 comprises a mute panel 102 having a plurality of mute apertures 104*a-d* formed thereon, and a plurality of music item apertures 106*a-c* formed thereon, wherein the mute apertures 104*a-d* and the music item apertures 106*a-c* can be formed in a linear and spaced-apart relationship, wherein a size of each of the mute apertures 104*a-d* is larger than a size of each of the music item apertures 106*a-c*.

In another aspect, the mute apertures and the music item apertures can be randomly formed on the mute panel, and each of the mute apertures can be sized and shaped to engage with a group of mutes consisting of trumpet harmon mutes, straight trombone mutes, trumpet cut mutes, and trumpet straight mutes. In other words, the music item apertures can be sized and shaped to engage with a variety of music related items.

In yet another aspect, each of the mute apertures 104*a-d* can be parallelly arranged with respect to each of the music item apertures 106*a-c*.

Accordingly, the musical instrument mute retention assembly 100 further comprises a mounting flange 108 comprising a sloped portion 1081 integrally and vertically extended from the mute panel 102, and a support portion 1082 downwardly extended from the sloped portion 1081 to form a corner portion 1083, wherein the sloped portion 1081 can be angled at between 60 to 90 degrees to the mute panel 102. In other words, the mounting flange 108 can be a U-shaped structure. The corner portion 1083 naturally defines a retaining slot 1084 formed between the sloped portion 1081 and the support portion 1082, wherein a width of retaining slot 1084 can be approximately 0.3 mm to 0.8 mm.

Figures 2, 3:
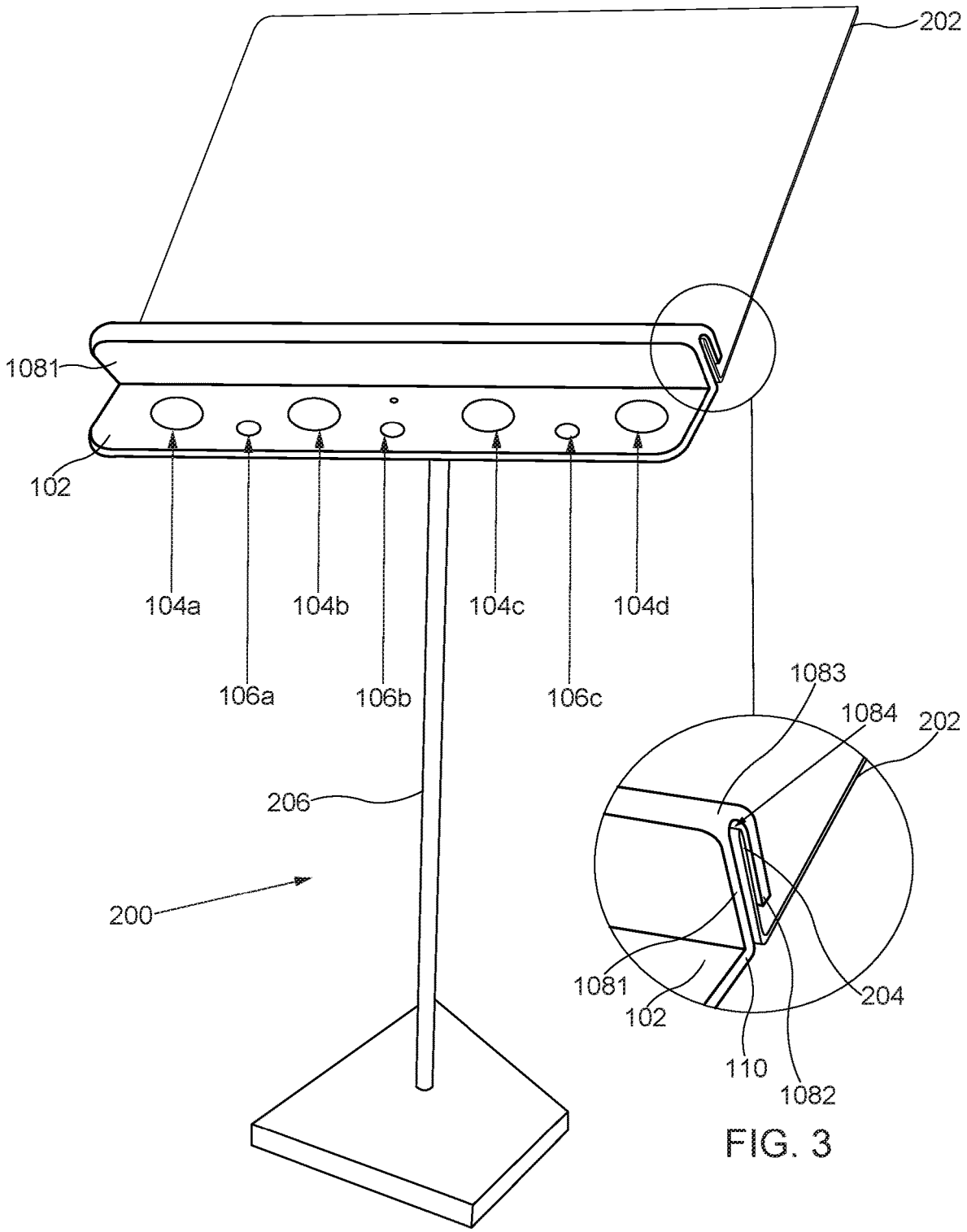
FIG. 2 is a perspective view of the musical instrument mute retention assembly, illustrating the musical instrument mute retention assembly being mounted on a music stand.
FIG. 3 is a side and sectional view of FIG. 2, illustrating the musical instrument mute retention assembly being mounted on a music stand.
Figure 4:
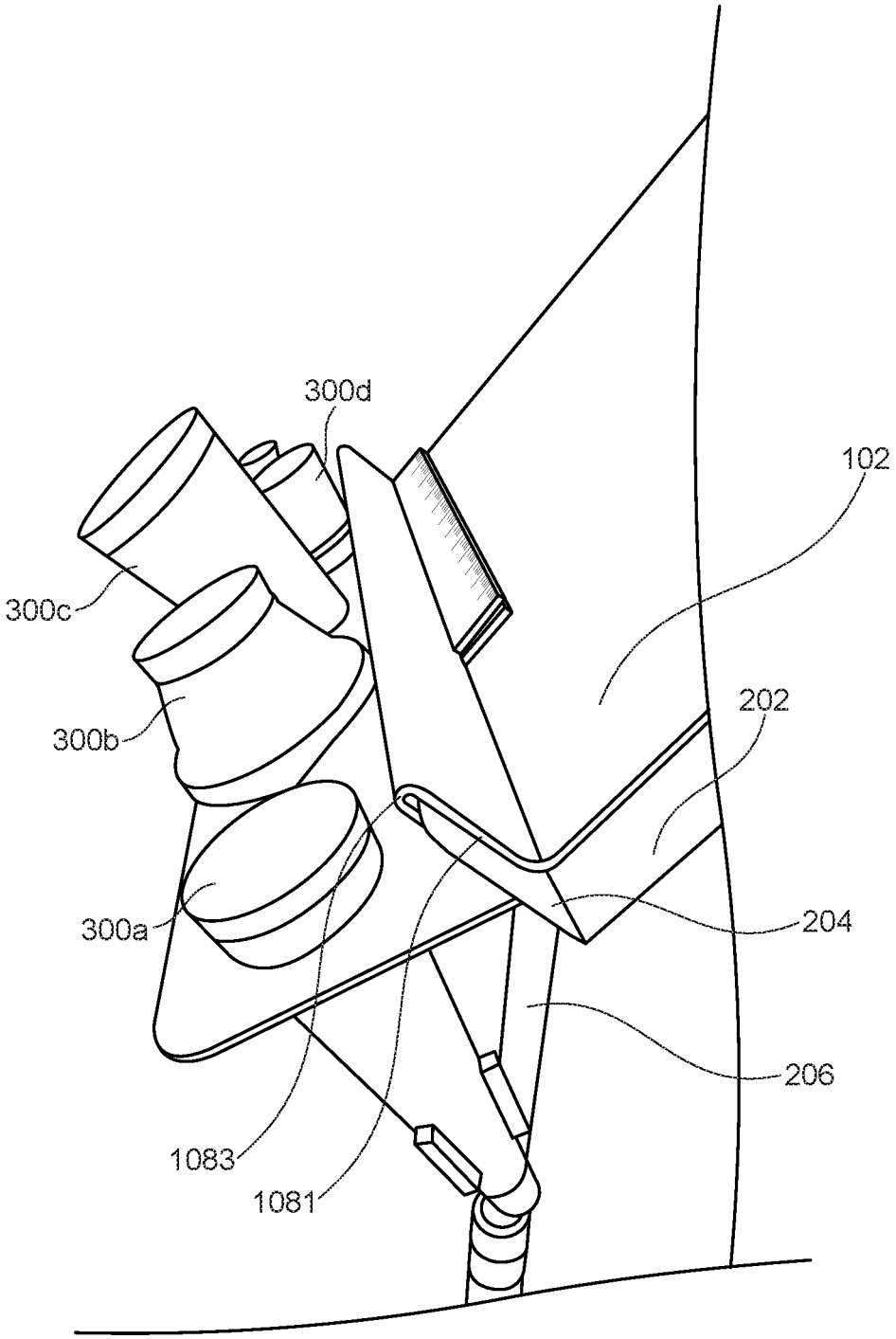
FIG. 4 is a perspective view of the musical instrument mute retention assembly, illustrating a plurality of music instrument mutes being suspended on a mute panel.

Referring to FIGS. 1 and 3 of the drawings, in one embodiment, the sloped portion 1081 is perpendicular to the mute panel 102, and the retained mutes 300*a-d* and music-related items are maintained parallel with the ground surface, which facilitates access to the apertures and retained mutes for the musician.

In one aspect, a diameter of each of the mute apertures 104*a-d* can be formed at between 1.925 inches to 3.575 inches, and a diameter of each of the music item apertures 106*a-c* can be formed at between 0.525 inches to 0.975 inches.

In another aspect, the musical instrument mute retention assembly 100 is an integrated piece, and in other words, a thickness of the whole musical instrument mute retention assembly 100 is unique. It is worth mentioning that, in one embodiment, the thickness of the musical instrument mute retention assembly 100, including the thickness of the mute panel 102 and the thickness of the mounting flange 108, is unique, wherein the thickness of the musical instrument mute retention assembly 100 can be approximately ⅛ of an inch.

In yet another aspect, a width H of the sloped portion 1081 is longer than a width h of the support portion 1082, wherein the width of the sloped portion 1081 is approximately ¼ longer than the length of the support portion 1082. According to the yet another aspect, a length G of the mute panel 102 is the same as a length of the sloped portion 1081, wherein the length G of the mute panel 102 can be approximately more than 15 center milters.

In still yet another aspect, the mute panel 102, the sloped portion 1081, and the support portion 1082 are rectangular and each of the mute panel 102, the sloped portion 1081, and the support portion 1082 has a flat surface.

In one embodiment of the present invention presented in FIGS. 1-4, a musical instrument mute retention assembly 100 is configured to mount to a music stand 200 at a parallel disposition with the ground surface, while also retaining multiple instruments mutes 300*a-d* of various sizes and musical-related items in a level, upright disposition. In this manner, a musician can play a musical instrument while retaining the instrument mutes 300*a-d* and music-related items in an adjacent, level disposition for easy access.

Accordingly, in one aspect, the plurality of mute apertures 104*a-d* can be configured to receive and retain the music instrument mutes 300*a-d* to be disposed on the mute panel 102, and the plurality of music item apertures 106*a-c* can be configured to receive and retain the music related items, wherein each of the mute apertures 104*a-d* and the music item apertures 106*a-c* are disposed on the mute panel 102 to form a continuous edge of the mute panel 102. In other words, no apertures can be formed along the peripheral edge of the mute panel 102.

In another aspect, there are four mute apertures 104*a-d* and three music item apertures 106*a-c* formed on the mute panel 102.

As shown in FIG. 2, the music stand 200 comprises a music book support 202 where the music books placed thereon, and a support shelf 204 extended from the music book support 202, wherein the musical instrument mute retention assembly 100 can be attached on the support shelf 204.

In one embodiment, a width of the support shelf 202 is slightly smaller than the diameter of the retaining slot 1084, wherein the support shelf 202 can be partially inserted into the retaining slot 1084 to lock the support shelf 202 with the retaining slot 1084. In other words, the support shelf 202 can be detachably interfaced with the retaining slot 1084 in slidable and fastenable engagement.

Figure 5:
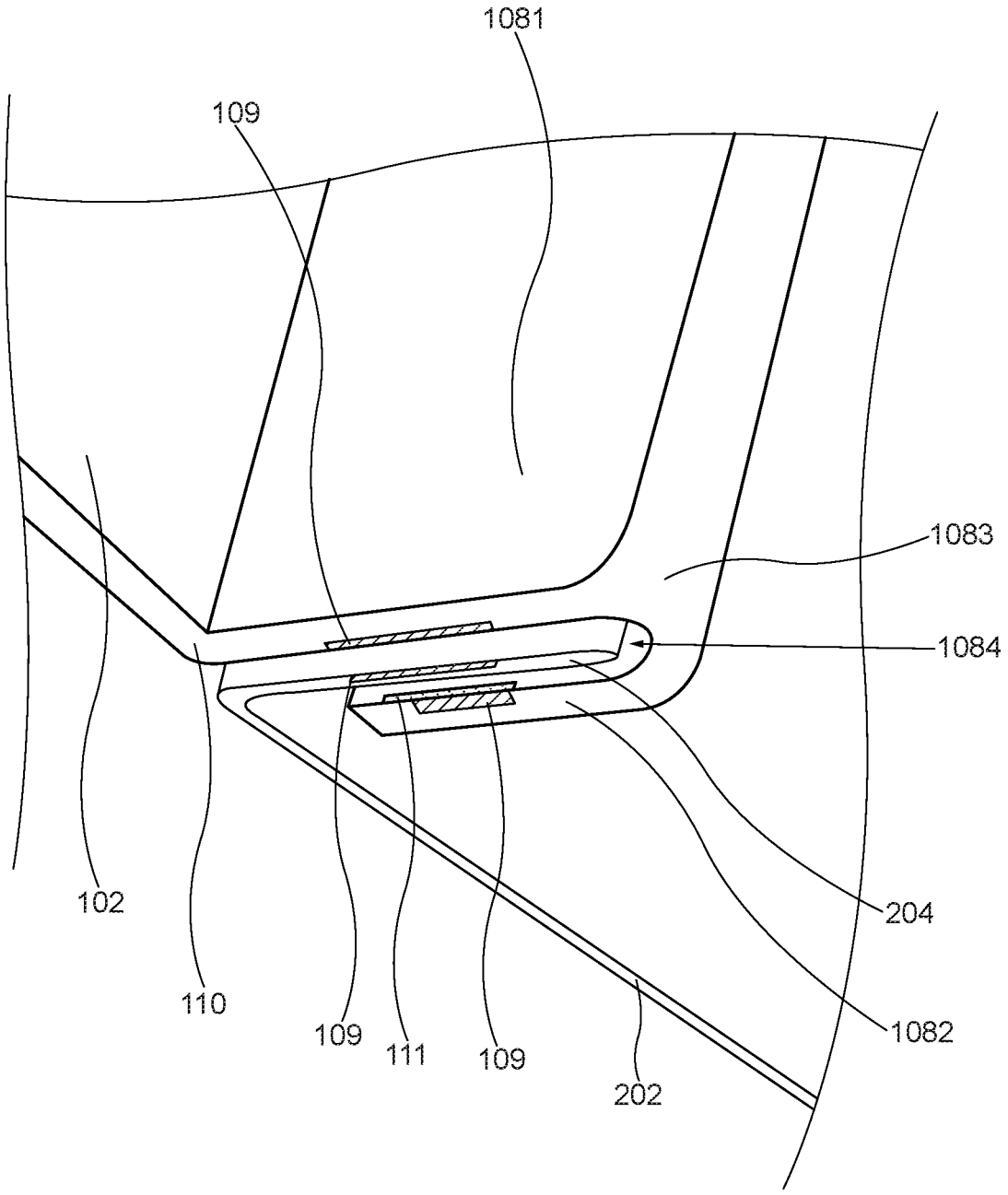
FIG. 5 is a side and sectional view of a music instrument mute retention assembly according to an alternative mode of the mounting flange, illustrating the musical instrument mute retention assembly being mounted on a music stand.

FIG. 5 depicts another alternative embodiment of the musical instrument mute retention assembly 100, wherein the structure of the musical instrument mute retention assembly 100 is similar to the structure of the disclosed embodiment as shown in FIG. 1, except that the musical instrument retention mute assembly 100 further comprises a plurality of rustic members 111 arranged on an inner surface 10831 of the corner portion 1083, wherein the rustic members 111 can be configured to provide the friction effect between the inner surface 10831 and the support shelf 204, so as to enhance the engagement therebetween.

A method of attaching the musical instrument mute retention assembly 100 on a music stand 200 and placing a plurality of music instrument mutes 300*a-d* and music related items on the musical instrument mute retention assembly 100 can comprise the following steps:

mount the musical instrument retention assembly 100 on the music stand 200 by inserting the shelf support 204 of the music stand 200 into a retaining slot 1084;

support a mute panel 102 to attach on the music stand 200 in parallel disposition with respect to a ground surface;

form a plurality of mute apertures 104*a-d* on a mute panel 102 in a linear, spaced-apart relationship; and form a plurality of music item apertures 106*a-c* on the mute panel 102 in a linear, spaced-apart relationship on the mute panel.

In one aspect, the plurality of music instrument mutes 300*a-d* can be suspended on the mute apertures 104*a-d*, and the plurality of music-related items can be suspended on the music item apertures 106*a-c*.

The method as mentioned above can further comprise the following step:

place the plurality of music instrument mutes 300*a-d* on the mute panel 102 in a way from top to bottom, and suspend the music instrument mutes 300*a-d* on the mute apertures 104*a-d;* place the plurality of music related items on the mute panel 102 in a way from top to bottom, and suspend the music instrument mutes 300*a-d* on the music instrument apertures 104*a-d*.

As referenced in FIG. 3, the assembly 100 is easily mountable to a conventional music stand 200. The music stand 200 may include a vertical supporting rod 206, a music book support 202 for retaining musical sheets, and a support shelf 204 that extends from the music book support 202. The support portion 202 supports musical papers, batons, and other music related items. Generally, the support shelf 204 joins the support portion 202 at an angle and extends in a generally vertical disposition.

In one embodiment, the support shelf 204 is angled at between 60 to 90 degrees to the support portion 202. In other words, the support portion 202 can be perpendicular to the ground surface.

The corner portion 1083 forms a gap that is sized and dimensioned to receive and clamp the support shelf 204 of the music stand 200. In this regard, the assembly 100 provides a unique perpendicular mounting flange 108 that abuts the support shelf 204 in a slidable or fastenable engagement, and with no tools required. Because of the perpendicular orientation of the mounting flange 108 relative to the mute panel 102, the retained musical mutes 300*a-d* and music-related items on the mute panel 102 are maintained parallel to the ground surface.

Turning now to FIG. 1, the assembly 100 comprises a mute panel 102 that forms the primary surface for retaining the mutes 300*a-d* and music-related items. In one non-limiting embodiment, the mute panel 102 has a generally flat, rectangular shape. The mute panel 102 is defined by a plurality of mute apertures 104*a-d* disposed in a linear, spaced-apart relationship. The mute apertures 104*a-d* are sized and dimensioned to retain musical mutes 300*a-d* in an upright disposition. In one embodiment, the mute apertures 104*a-d* comprises four mute apertures 104*a-d*. Though in other embodiments, more or less mute apertures 104*a-d* may be used. The mute apertures 104*a-d* may be defined by a generally circular shape for accommodating wind instrument mutes 300*a-d*. Though in other embodiments, other shapes for the mute apertures 104*a-d* may be used, depending on the type and size of mute 300*a-d* that are being retained.

The mute panel 102 also forms multiple spaced-apart smaller holes that can hold other music-related objects beyond an instrument mute. In one embodiment, the mute panel 102 is defined by a plurality of music item apertures 106*a-c* arranged in a linear, spaced-apart relationship. The music item apertures 106*a-c* are arranged to a position parallel to the mute apertures 104*a-d*.

In some embodiments, the music item apertures 106*a-c* may be defined by a generally circular shape for accommodating music related items, such as mouthpieces, writing instruments, instrument oil containers, and mouthpieces. Though in other embodiments, other shapes may be used for the music item apertures 106*a-c*, depending on the music-related items being retained. The music item apertures 106*a-c* may have a circular shape that is smaller in diameter than the mute apertures 104*a-d*. In one non-limiting embodiment, the music item apertures 106*a-c* comprise three music item apertures 106*a-c*. Though in other embodiments, more or less music item apertures 106*a-c* may be used.

Looking back at FIGS. 1 and 2, the assembly 100 further provides a mounting flange 108 that fixedly attaches the mute panel 102 to the music stand 200. The mounting flange 108 attaches to the mute panel 102 at a junction 110, forming a generally perpendicular relationship, wherein the junction 110 can be formed as a smooth and curve contour.

In one non-limiting embodiment, the mounting flange 108 meets the mute panel 102 at the junction 110, in a generally perpendicular disposition. In another embodiment, the mounting flange 108 has a generally flat, rectangular shape, and is generally smaller than the mute panel 102.

The mounting flange 108 is mountable to the music stand 200 in a slidable or fastenable relationship. Specifically, the mounting flange 108 interfaces with the support shelf 204 that extends from the music book support 202 of the music stand 200 in the slidable or fastenable engagement. In one non-limiting embodiment, the mounting flange 108 slidably interfaces with the support shelf 204 from the music stand 200. The corner portion 1083 of the mounting flange 108 can be configured to receive the support shelf 204.

Referring to FIG. 3 of the drawings, in another embodiment, the corner portion 1083 comprises an inner surface 10831 to engage and disengage with the support shelf 204 to create a friction coefficient between them, wherein the support portion 1082 and the sloped portion 1081 are parallel to the support shelf 204.

In yet another embodiment, a bolt or screw can be used to press the mounting flange 108 and the support shelf 204 of the music stand 200 to enhance an engagement therebetween.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

What I claim is:

1. A musical instrument mute retention assembly, comprising:

a mute panel comprising a plurality of mute apertures arranged thereon in a linear, spaced-apart relationship;

a plurality of music item apertures formed in a linear, spaced-apart relationship on the mute panel; and a U-shaped mounting flange integrally and vertically extended from the mute panel; wherein the mounting flange comprising a sloped portion vertically extended from the mute panel and a support portion integrally extended from the sloped portion to form a retaining slot configured to mount on a music stand in a slidable or fastenable engagement;

wherein the mute panel has a forward continuous edge having no opening formed along the edge.

2. The assembly of claim 1, wherein the mute panel has two continuous left and right edges and no opening is formed along the two edges of the mute panel.

3. The assembly of claim 1, wherein the music item apertures can be arranged parallelly to the mute apertures.

4. The assembly of claim 1, wherein the mute panel is arranged parallelly to the ground surface.

5. The assembly of claim 1, wherein the sloped portion can be perpendicularly extended with respect to the mute panel.

6. The assembly of claim 1, wherein the retaining slot can be configured to engage with a support shelf of the music stand to support the mute panel on the music stand.

7. The assembly of claim 1, wherein the mute panel has a generally flat, rectangular shape.

8. The assembly of claim 1, wherein the plurality of mute apertures comprises four mute apertures.

9. The assembly of claim 1, wherein the plurality of mute apertures are sized and dimensioned to retain a musical instrument mute in an upright disposition.

10. The assembly of claim 1, wherein the plurality of music item apertures comprises three music item apertures.

11. The assembly of claim 1, wherein the mounting flange has a generally flat, rectangular shape.

12. The assembly of claim 1, wherein a width of the mounting flange is generally smaller than a width of the mute panel.

13. The assembly of claim 1, wherein the musical instrument mute retention assembly is an integrated piece.

14. The assembly of claim 1, wherein a width of the support portion is shorter than a width of the sloped portion.

15. A method of mounting a musical instrument retention assembly to a music stand having a music book support and a support shelf and placing a plurality of music instrument mutes and music related items on the musical instrument retention assembly, the method comprising:

mounting the musical instrument retention assembly on the music stand by inserting the shelf support of the music stand into a U-shaped mounting flange vertically extended from a mute panel having a forward continuous edge with no opening formed thereon;

forming a plurality of mute apertures on the mute panel in a linear, spaced-apart relationship;

forming a plurality of music item apertures on the mute panel in a linear, spaced-apart relationship;

defining a sloped portion vertically extended from the mute panel;

defining a support portion integrally extended from the sloped portion to form a retaining slot on the U-shaped mounting flange to engage with a music stand in a slidable or fastenable engagement; and placing a plurality of music instrument mutes into the mute apertures in a way from top to bottom.

* * * * *